US006578492B1

(12) United States Patent
Koch et al.

(10) Patent No.: US 6,578,492 B1
(45) Date of Patent: Jun. 17, 2003

(54) PYROTECHNIC SMOKE SCREEN UNITS FOR PRODUCING AN AEROSOL IMPENETRABLE IN THE VISIBLE, INFRARED AND MILLIMETRIC WAVE RANGE

(75) Inventors: Ernst-Christian Koch, Kaiserslautern (DE); Josef Schneider, Kirchheim (DE)

(73) Assignee: Pepete GmbH, Hanau (DE)

( * ) Notice: Subject to any disclaimer, the term of this patent is extended or adjusted under 35 U.S.C. 154(b) by 0 days.

(21) Appl. No.: 09/937,617

(22) PCT Filed: Jan. 24, 2000

(86) PCT No.: PCT/EP00/00499

§ 371 (c)(1),
(2), (4) Date: Sep. 27, 2001

(87) PCT Pub. No.: WO00/58238

PCT Pub. Date: Oct. 5, 2000

(30) Foreign Application Priority Data

Mar. 27, 1999 (DE) ..... 199 14 095

(51) Int. Cl.[7] ..... F42B 12/48
(52) U.S. Cl. ..... 102/334; 102/336
(58) Field of Search ..... 102/334, 336

(56) References Cited

U.S. PATENT DOCUMENTS

| | | | | |
|---|---|---|---|---|
| 3,725,927 A | | 4/1973 | Fielder | |
| 5,049,883 A | | 9/1991 | Woodward | |
| 5,337,671 A | * | 8/1994 | Varmo | 102/334 |
| 5,445,078 A | * | 8/1995 | Marion | 102/505 |
| 5,656,794 A | * | 8/1997 | Krone et al. | 102/334 X |
| 6,047,644 A | * | 4/2000 | Malecki et al. | 102/367 |
| 6,283,033 B1 | * | 9/2001 | Wu et al. | 102/336 X |
| 6,412,416 B1 | * | 7/2002 | Rouse et al. | 102/336 |

FOREIGN PATENT DOCUMENTS

| | | |
|---|---|---|
| DE | 31 47 850 | 6/1983 |
| DE | 43 37 071 | 3/1995 |
| EP | 0 108 939 | 5/1984 |
| GB | 2 162 621 | 2/1986 |
| WO | 92/13251 | 8/1992 |
| WO | 96/01912 | 1/1996 |

* cited by examiner

*Primary Examiner*—Peter A. Nelson
(74) *Attorney, Agent, or Firm*—Foley & Lardner

(57) ABSTRACT

The invention relates to a pyrotechnic smoke screen unit for producing an aerosol which is impenetrable in the visible, infrared and millimetric wave range and used for camouflage and decoy purposes. The units are obtained by combining fibre-like conductive dipoles or dipole precursors which become conductive in situ and conventional pyrotechnic smoke substances active in the visible and infrared range.

2 Claims, 1 Drawing Sheet

Figure 1:
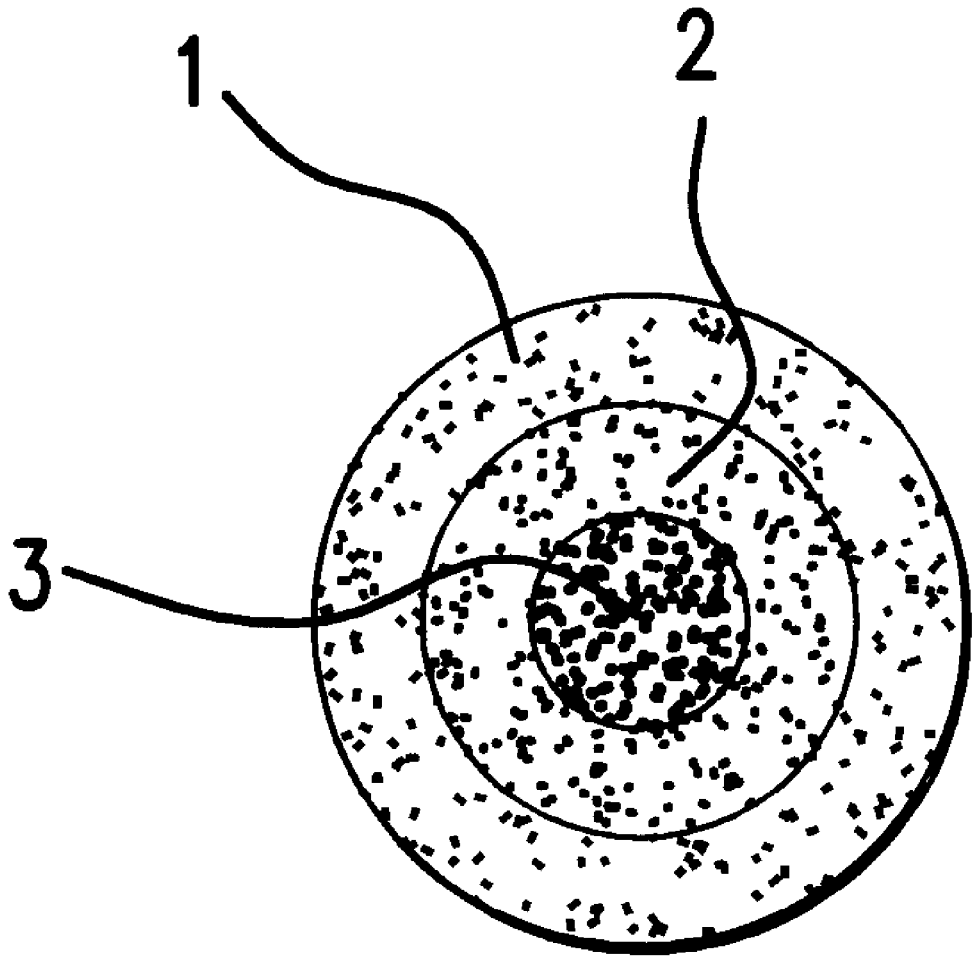

PYROTECHNIC SMOKE SCREEN UNITS FOR PRODUCING AN AEROSOL IMPENETRABLE IN THE VISIBLE, INFRARED AND MILLIMETRIC WAVE RANGE

The present invention concerns a pyrotechnic smoke screen for the production of an aerosol impenetrable in the visible, infrared and millimetric wave, range. The human and ecotoxicologically compatible screening agents, consist of previously produced dipoles for radiations in the frequency range of 2–300 GHz which are suitable for the production of an aerosol impenetrable in the millimetric wave range and suitable suitable smoke materials which absorb in the visible and infrared range.

Pyrotechnically produced aerosols are today preponderantly used in the military field for camouflaging, disguising, screening, simulating and marking.

A main problem in the use of camouflaging aerosols consists in the screening of electromagnetic radiation in the frequency range of 2–300 GHz, preferably in the atmospheric damping windows between 2–18 GHz and especially at 35, 94, 140 and 220 GHz since in these frequency bands work typically target acquisition and tracking systems (radar; apparatus) of ground-ground missiles (e.g. SMArt 155, Longbow Hellfire).

As methods for the camouflaging in this frequency range, at the moment one only knows two methods a) the explosive dispersion of suitable dipoles, e.g. aluminised glass fibres and nickel-coated nylon fibres with dipole length adapted in the range b) pyrotechnical production of graphite fibres by thermally induced expansion of of graphite intercalation compounds.

An example for the thermally induced expansion of graphite compounds for the purpose of aerosol production is described in DEE 4337071 Cl.

The general disadvantages of both methods consists first in the complete transparency of these aerosols for visible radiation and the near to middle infrared. As further disadvantages, it always comes, in the case of the explosive dispersion of previously produced particles, to the so-called bird nesting. Under this, one under stands the hole with very low particle density brought about by the explosion event in the middle of the aerosol cloud. At this place of the cloud, the line of sight (LOS) is not blocked. Furthermore, the known dipoles sink very quickly to the ground because of their specific weight so that only unsatisfactory covering times are achieved.

The strands and spiral-shaped graphite fibres produced by thermally induced expansion of granite intercalation compounds are present, with regard to their length, only statistically distributed. Thus, it is not possible only to produce graphite fibres of definite length (e.g. at 35 and 94 GHz) which has the result that the effectiveness (damping capacity) of so produced aerosols is only very limited in individual spectral ranges. Furthermore, alveoli-accessible particles are also produced which makes evident the risk of respiratory tract diseases.

Therefore, the task exists to find new aerosols impenetrable in the visible, infrared and millimetric wave range which, furthermore, are human and ecotoxologically compatible.

It has now been found that conventional pyrotechnical smoke screens hindering transmission in the visual and infrared range can solve the above-described problems by addition of pre-produced dipoles coated with pyrotechnical materials.

For this purpose, the smoke screens according to the invention contain, as pre-produced heats-stable dipoles of graphite, a ceramic material made conductive or in situ conductive, such as for example zirconium oxide or aluminium oxide, which are coated with pyrotechnical materials. These dipoles are entrained by the hot gas clouds in the case of the burning away of the known smoke screen.

The dipoles consist of thin, conductive fibres, the length, of which is coordinated with frequency bands usual for the typical target acquisition and tracking systems. For the frequencies of 35, 94, 140 and 220 GHz, there is used, for example, a mixture of lengths of 1 to 30 mm. The fibre diameter lies at 0.001 to 0.1 mm, preferably 0.005 to 0.02 mm.

The conductive fibres consist either of metal or graphite which is produced by carbonisation of spun synthetic material fibres which are made conductive by metal coating. Methods for the coating of surfaces with a very thin metal film are known.

For example, metals can be deposited on the fibres from the gas phase. Furthermore, the pure metals can be deposited on the fibres from transition metal organyls, especially carbonyls, by heating at reduced pressure. Alternatively, the making conductive in situ with the help of a pyrotechnical coating is also conceivable. This could react under the influence of the reaction heat of the main batch with the formation of a conductive e.g. metallic coating. Therefore, as coating material for the ceramic fibres, there come into question pyrotechnical switch systems suitable systems are, given in scheme, 1.

$$2\ PbO+Si \rightarrow SiO_2+2\ Pb$$

$$2\ CuO+Si \rightarrow SiO_2+2\ Cu$$

$$2\ CuO+Ti \rightarrow TiO_2+2\ Cu$$

$$3\ NiO+2B \rightarrow B_2O_3+3\ Ni$$

As is shown in FIG. 1, the dipole fibre 3 according to the invention is first coated with a phosphorus or phosphorus sulphide coating 2 which, after the application and distribution of the dipoles and the uplift thereof increases or slows down their rate of sinking and additionally produces a strong IR emission. Furthermore, these fibres also have an ignition coating 1 which contains a known, easily ignitable pyrotechnical mass of a combustible material, for example red phosphorus, hexachlorocyclohexane, metal powder etc., an oxidation agent, for example alkali metal nitrate, alkali metal chlorate etc., and a binding agent of a polymeric synthetic material and possibly also burning off moderators.

For stability reasons and as oxidation protection, there can possibly also be provided a covering layer (not shown in the Figure) of a synthetic material lacquer. All layers correspond in their thickness to the order of magnitude of the fibre thickness itself, i.e. have, thicknesses of 0.001 to 0.1 mm, preferably 0.01 to 0.02 mm, and are usually produced by dipping in or spraying of the fibres with appropriate solutions or suspensions of the components and drying of the solvent.

The fibre dipoles according to the invention are mixed with per se known pyrotechnic smoke screen masses which produce aerosols strongly scattering and absorbing in the visible and infrared spectral range and formed in pressed bodies or granulates suitable for the production. In also known manner, these are combined with appropriate igniters, ignition charges etc in casings to give the desired smoke screen launchers, smoke screen grenades or rockets. The corresponding techniques are identical with those of known smoke screen bodies for IR and visible spectrum so that a separate description is not given.

The following Example is to illustrate the invention without, however, limiting it:

EXAMPLE 500 g graphite fibres (50% 35 GHz, 25% 94 GHz, 12.5% 144 GHz and 12.5% 220 GHz fibre cut) are shaken for 5 min. in a saturated solution of phosphorus sesqui-sulphide in carbon disulphide and dried in a vacuum at 40° C. and 20 mbar.

After the drying of the fibres, these are coated by dipping in a suspension of red phosphorus (50%), bis-($\eta^5$-cyclopentadienyl)-iron (25%), potassium nitrate (23%) and a novolac binder (2%).

From 100 g pretreated fibres and a conventional smoke screen batch, for example according to the following formulation, is produced an effective mass, from 2750 g red phosphorus, 990 g potassium nitrate, 220 g silicon, 220 g boron, 220 g zirconium/iron alloy and 990 g macro-plast binder (30% solids) is produced a pasty batch by stepwise addition of the components to the red phosphorus. The solvent-moist mass is sieved (7 mm mesh width) and dried for 20 minutes in a vacuum at 40° C. and 20 mbar. The granulate is pressed with an applied pressure of 20 tonnes to give cylindrical pressed bodies of 7 mm edge height and 74 mm diameter. A tablet possesses a burning time of about 27 seconds.

The laboratory-produced smoke screen according to the invention damps down the radiation in the infrared and visible very well (95%), furthermore in the millimetric wave range in the frequency bands in question (35, 94, 140 and 220 GHz), a damping down of, in each case, about 20 dB is achieved.

What is claimed is:

1. A pyrotechnic smoke screen unit for the production of an aerosol for camouflage and decoy purposes impenetrable in visible, infrared and millimetric wave ranges comprising pre-produced dipoles selected from the group consisting of fiber-formed conductive dipoles and dipole precursors which become conductive in situ, wherein the dipoles consist of thin, conductive fibers of metal, graphite or of glass, ceramic or synthetic material fibers which are provided with a conductive coating of metal and have a length of 1 to 30 mm and a diameter of 0.001 to 0.1 mm, wherein the fibers are coated with a first layer of phosphorus or phosphorus sulfide and a second ignition layer of a combustible material, an oxidation agent and a binding agent, whereby these layers have thicknesses of 0.001 to 0.1 mm, wherein the pre-produced dipoles correspond to electromagnetic radiation in the millimetric wave region of the frequency bands for the targeting apparatus, wherein pyrotechnic smoke screen unit contains 5 to 25% of fiber-formed conductive dipoles or dipole precursors which become conductive in situ.

2. The pyrotechnic unit according to claim 1, wherein dipoles of graphite fibers are coated with phosphorus sesquisulfide, as well as with a mixture of 50% red phosphorus, 25% bis-($\eta^5$-cyclo-pentadienyl)-iron, 23% potassium nitrate and 2% novolac binder.

* * * * *